United States Patent [19]

Goel

[11] 3,954,333

[45] May 4, 1976

[54] TRANSFER ROLL HAVING MEANS FOR MONITORING AND CONTROLLING THE RESISTIVITY THEREOF

[75] Inventor: Narendra S. Goel, Henrietta, N.Y.

[73] Assignee: Xerox Corporation, Stamford, Conn.

[22] Filed: Jan. 10, 1975

[21] Appl. No.: 540,302

[52] U.S. Cl. ..... 355/3 R; 355/30

[51] Int. Cl.[2] ..... G03G 15/22

[58] Field of Search ..... 355/3 R, 3 TR, 30; 96/1.4; 118/637

[56] References Cited

UNITED STATES PATENTS

| | | | |
|---|---|---|---|
| 3,591,276 | 7/1971 | Byrne | 355/3 TR |
| 3,634,007 | 1/1972 | Verderber et al. | 355/3 R |
| 3,677,632 | 7/1972 | MacDonald | 355/3 R |
| 3,685,896 | 8/1972 | Kaupp | 355/3 TR |
| 3,781,105 | 12/1973 | Meagher | 355/3 TR |
| 3,837,741 | 1/1974 | Spencer | 355/3 R |
| 3,877,416 | 4/1975 | Donohue et al. | 118/637 |
| 3,893,761 | 7/1975 | Buchan et al. | 355/3 TR |

FOREIGN PATENTS OR APPLICATIONS

| | | |
|---|---|---|
| 45-21339 | 8/1970 | Japan |

*Primary Examiner*—L. T. Hix
*Assistant Examiner*—Kenneth C. Hutchinson
*Attorney, Agent, or Firm*—B. A. Chiama; Earl T. Reichert

[57] ABSTRACT

Apparatus is provided for heating an electrically biased transfer roll in an electrostatic reproduction machine so as to improve the transfer of a developed electrostatic image from a photoreceptor to a transfer member during operation of the machine. The roll is heated to maintain the resistivity thereof within a range which will effect optimum transfer, and to alleviate the detrimental effects of ambient temperature changes on the resistivity.

2 Claims, 2 Drawing Figures

TRANSFER ROLL HAVING MEANS FOR MONITORING AND CONTROLLING THE RESISTIVITY THEREOF

BACKGROUND OF THE INVENTION

This invention relates generally to an improved electrically biased transfer roll for an electrostatic reproduction machine. More particularly, the invention relates to a transfer roll having apparatus for heating the roll so as to improve the transfer of a developed image from a photoreceptor to a support member such as a sheet of paper during operation of the machine.

In the practice of xerography as described in U.S. Pat. No. 2,297,691 of Chester F. Carlson, a xerographic surface comprising a layer of photoconductive insulating material affixed to a conductive backing is used to support electrostatic images. In the usual method of carrying out the process, the xerographic plate (photoreceptor) is electrostatically charged uniformly over its surface, and then exposed to a light pattern of the image being reproduced to thereby discharge the charge in the areas where light strikes the layer. The undischarged areas of the layer thus form an electrostatic charge pattern or electrostatic latent image in conformity with the configuration of the original pattern.

The latent electrostatic image is developed by contacting it with a finely divided electrostatically attractable material, such as a resinous powder. The powder is held in the image areas by the electrostatic fields on the layer. Where the field is greatest, the greatest amount of material is deposited, and where the field is least, little or no material is deposited. Thus, a powder image is produced in conformity with the image of the original being produced. The powder image is subsequently transferred to a sheet of paper or other transfer member, and suitably affixed thereto to form a permanent copy.

The latest concept for electrostatic reproduction machines utilizes high speed flash exposure of the document, and a moving photoconductive material in the form of an endless belt which is continuously charged. Additionally, such reproduction machines are provided with a developing system which supplies toner particles in relatively large quantities for solid area coverage, such as a magnetic brush developing apparatus. Thus, after the belt passes the magnetic brush assembly, for example, a xerographic powder image is formed on the belt which corresponds to the electrostatic latent image. This powder image is then transferred to a support member (e.g., a sheet of paper) to which it is fused by a fusing assembly whereby the powder image is caused to adhere to the support surface permanently.

The latest electrostatic reproduction machines are high speed machines which print copies at a rate substantially in excess of any previous electrostatic reproduction machines, and are intended to compete with other types of printing machines, e.g., offset printing machines. Because of this, it is desired that the quality of the copies made, be extremely high. Important to high quality copies is an effective transfer apparatus for transferring the developed image from the photoreceptor to the support member. An electrically biased transfer roll includes a conductive core connected to an electrical source, and an elastomeric layer surrounding the core. The elastomeric layer contacts the paper during transfer, and an electric field is generated to transfer the developed electrostatic image from the photoreceptor to the paper. For optimum transfer, the resistivity of the transfer roll must be within a certain range. It has been found that ambient conditions such as temperature and humidity vary the resistivity of the transfer roll. In that embodiment of the transfer roll in which the transfer roll current is kept constant, it is desirable to control the resistivity to approximately within a factor of 8 or less. Many materials used for transfer rolls, however, have variations of resistivity larger than this factor in the temperature and humidity ranges in which the machine is expected to be operated. With many of these materials, temperature has been identified as the most significant variable contributing to this large variation in the resistivity of the transfer roll.

SUMMARY OF THE INVENTION

It is an object of the present invention to effect optimum level transfer by maintaining the roll at a temperature which will maintain the resistivity of the roll at a value which will effect that optimum level of transfer.

The present invention is directed to an improved transfer roll having means within the roll for heating the roll. Either the transfer roll potential or the current is used as a resistivity indicator depending upon whether the system is a constant current or a constant potential one. The resistivity of the roll is then controlled by turning the heating means on and off.

DETAILED DESCRIPTION OF THE INVENTION

Figure 1:
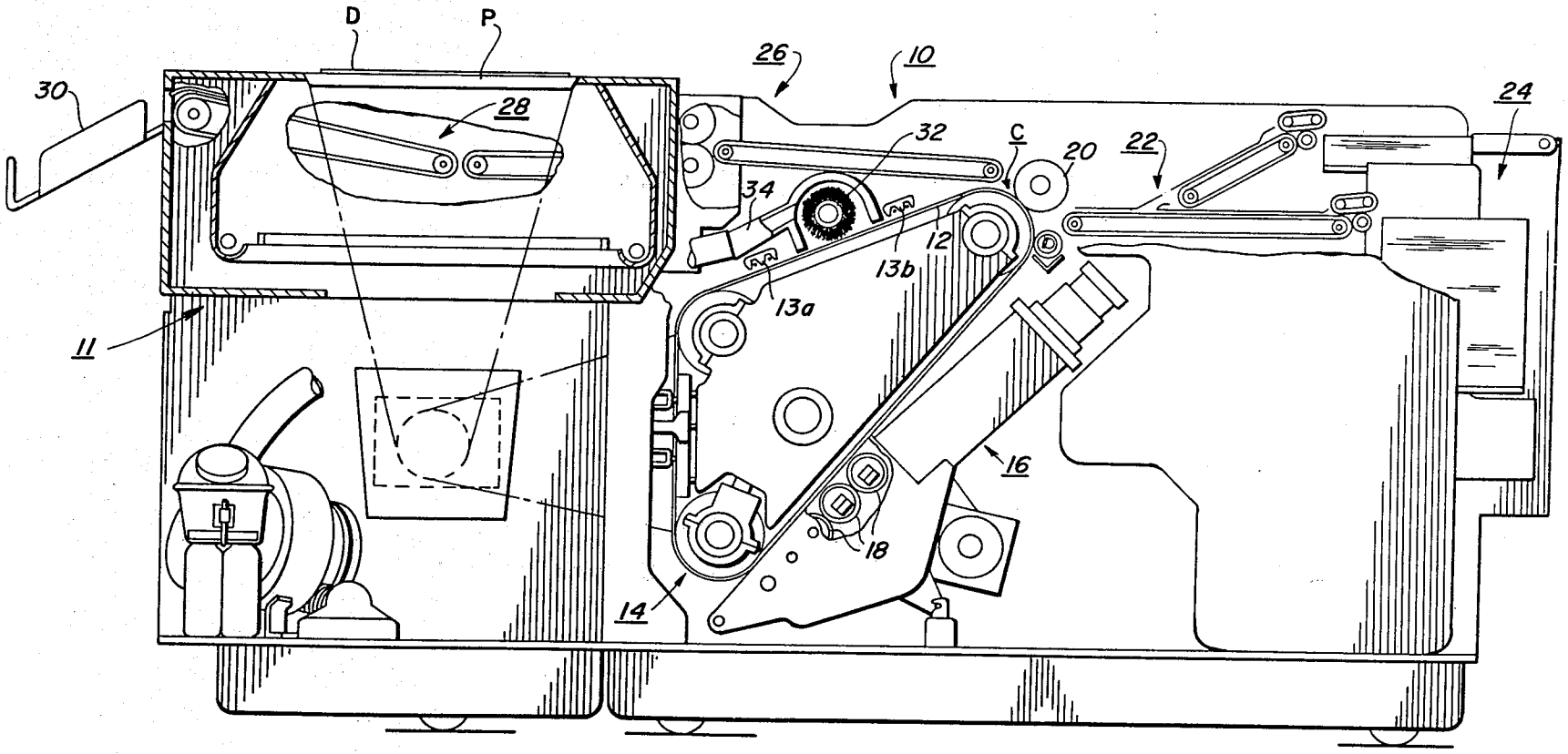
FIG. 1 is a schematic sectional view of an electrostatic reproduction machine embodying the principles of the present invention.

For a general understanding of an electrostatic reproduction machine in which the invention may be incorporated, reference is made to FIG. 1 in which the various system components for the machine are schematically illustrated. As in all electrostatic systems of the type illustrated, a light image of a document to be reproduced is projected onto the sensitized surface of a xerographic plate to form an electrostatic latent image thereon. Thereafter, the latent image is developed with an oppositely charged developing material to form a xerographic powder image corresponding to the latent image on the plate surface. The powder image is then electrostatically transferred to a support surface to which it may be fused by a fusing device whereby the powder image is caused to adhere permanently to the support surface.

In the illustrated machine 10, an original document D to be copied is placed upon a transparent support platen P fixedly arranged in an illumination assembly indicated generally by the reference number 11, arranged at the left end of the machine; a platen cover (not shown) is then lowered onto the original D to cover the same. While upon the platen P, an illumination system flashes light rays upon the original thereby producing image rays corresponding to the informational areas of the original. The image rays are projected by means of an optical system for exposing the photosensitive surface of the xerographic plate or photoreceptor in the form of a flexible photoconductive belt (photoreceptor) 12. The surface of the belt was made photoconductive by the previous step of uniformly charging the same by means of a corona generating device 13. In order to effect image processing, the belt 12 is arranged on a belt assembly indicated generally by the reference numeral 14.

The photoconductive belt assembly 14 is slidably mounted upon two support shafts, one of which is secured to the frame of the machine, and is adapted to drive a belt 12 in the direction of the arrow at a constant rate. During this movement of the belt, the refelcted light image of an original on the platen is flashed upon the surface of the belt to produce electrostatic latent images thereon at an exposure station A.

As the belt surface continues its movement, the electrostatic latent image passes through a developing station B in which there is positioned a developer indicated generally by the reference numeral 16. This developer provides development of the electrostatic latent image by magnetic brushes 18.

The developed electrostatic image is then transported by the belt to a transfer station C where a sheet of copy paper is moved between a transfer roll 20 and the belt at a speed in synchronism with the moving belt in order to effect transfer of the developed image. Such a transfer roll conventionally includes a conductive substrate connected to a power source with one or more layers of elastomeric material surrounding the substrate. When a sheet of paper passes between the transfer roll and photoreceptor, a high electrical field is generated to transfer the toner from the photoreceptor to the paper. There is provided at this station a sheet transport mechanism indicated generally by the numeral 22 which is adapted to transport sheets of paper from a paper handling mechanism indicated generally by the reference numeral 24 to the developed image on the belt at station C.

After the developed image is transferred to the sheet, the latter is stripped from the belt 12 and conveyed into a fuser assembly indicated generally by the reference numeral 26 where the developed and transferred xerographic powder image on the sheet is permanently affixed thereto. After each copy is thus produced, it is delivered via sheet transport mechanism 28 to an output tray 30.

After the image has been transferred at the transfer station C, the belt then moves past a corona generating device 32 where the residual background for the residual toner particles is loosened as a result of an appropriate charge being placed on the residual toner by the corona generating device 13b. The residual toner may then be more easily removed by a cleaner brush 32 after which the toner is removed by the vacuum duct 34.

Additional details regarding the subject electrostatic reproduction machine are set forth in a copending U.S. Pat. application, Ser. No. 312,411, assigned to the same assignee. Although not specifically discussed herein, it is understood that the present invention may also be used in other types of electrostatic copying or duplicating machines, and is not limited to the high speed duplicating machine disclosed herein.

Figure 2:
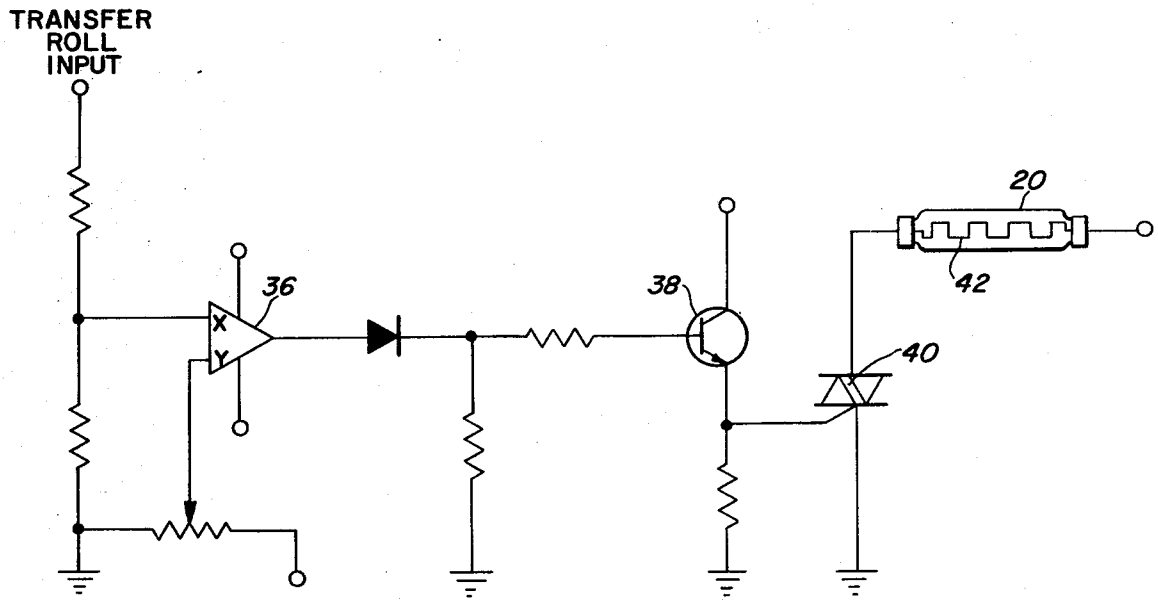
FIG. 2 is a schematic drawing of a first embodiment of the invention showing a transfer roll with a heater located with in the roll.

Referring to FIG. 2, a schematic view of an embodiment of the invention is shown for a constant current power supply for the transfer roll system. Either a constant current or a constant voltage power supply may be used to supply power to the transfer roll 20. See U.S. Pat. Nos. 3,781,105, 2,807,233 and 2,576,047 for examples of such power supplies. An input signal coming off the transfer roll is delivered to input gate *x* of operational amplifier 36 and compared with a reference signal delivered to reference gate *y;* as a result of this comparison, an appropriate output signal from the amplifier is produced. The input signal delivered to input gate *x* will change with changes in temperature of transfer roll 20. An appropriate output signal from transistor 38 is generated in response to the output from amplifier 36 to control triac 40. The amount of energy generated by the heater 42 is thus dependent upon the triac 38. Because the heater 42 is located within the transfer roll 20, the resistivity of the roll can thus be very accurately controlled by maintaining the roll at a desired temperature.

While the invention has been described with reference to the structure disclosed, it is not confined to the details set forth, but is intended to cover such modifications or changes as may come within the scope of the following claims.

What is claimed is:

1. An electrostatic reproduction machine having a photoreceptor, means for producing a developed electrostatic image on the photoreceptor, and an improved electrically biased transfer roll for transferring the image from the photoreceptor to a support member during operation of the machine, the improvement comprising means for maintaining the resistivity of the roll within a desired range regardless of ambient temperature changes, the resistivity maintaining means comprising means for monitoring the resistivity of the transfer roll during ambient temperature changes.

2. An electrostatic reproduction machine according to claim 1, wherein the resistivity maintaining means comprises means for heating the transfer roll in response to changes in the resistivity of the transfer roll.

* * * * *